United States Patent [19]

Quittner

[11] Patent Number: 4,498,803

[45] Date of Patent: Feb. 12, 1985

[54] MOVEABLE LANE BARRIER LOCKING SYSTEM

[75] Inventor: John P. Quittner, Castle Cove, Australia

[73] Assignee: Quicksteel Engineering Pty. Ltd., Botany, Australia

[21] Appl. No.: 509,184

[22] Filed: Jun. 29, 1983

Related U.S. Application Data

[63] Continuation-in-part of Ser. No. 485,622, Apr. 18, 1983, , which is a continuation-in-part of Ser. No. 344,755, Feb. 1, 1983, abandoned.

[51] Int. Cl.[3] ..... E01F 13/00

[52] U.S. Cl. ..... 404/6; 404/13

[58] Field of Search ..... 404/6, 9, 12, 13, 14, 404/71, 72, 83; 403/300, 301, 306, 363; 256/13.1; 52/582, 601

[56] References Cited

U.S. PATENT DOCUMENTS

| | | | |
|---|---|---|---|
| 3,958,890 | 5/1976 | Ferrari | 404/9 |
| 3,980,279 | 9/1976 | Bofinger | 256/13.1 |
| 4,412,756 | 11/1983 | Dunwoodie et al. | 403/363 |

*Primary Examiner*—Stephen J. Novosad
*Assistant Examiner*—Bruce M. Kisliuk
*Attorney, Agent, or Firm*—Phillips, Moore Lempio & Finley

[57] ABSTRACT

A plurality of closely spaced and pivotally interconnected divider sections form a roadway lane divider and barrier. The divider sections are adapted to be lifted and transferred on a roadway as a unit. A plurality of releasable locking members are reciprocally mounted on respective pairs of the divider sections to either lock them together against relative pivotal movement or to selectively release the locking members to permit the divider sections to freely pivot relative to each other when they are lifted for transfer purposes.

11 Claims, 5 Drawing Figures

2
6
19
16
17
1
15
12
18
20

MOVEABLE LANE BARRIER LOCKING SYSTEM

CROSS REFERENCE TO RELATED APPLICATIONS

This application is a continuation-in-part of my co-pending application Ser. No. 485,622 filed Apr. 18, 1983, which is a continuation-in-part of my co-pending application Ser. No. 344,755 filed Feb. 1, 1983, now abandoned. Application Ser. No. 485,622 is herein incorporated by way of reference.

DESCRIPTION

1. Technical Field

The present invention relates to a system of transferrable roadway lane barrier dividers and a method of transferring said dividers, and in particular to a method of locking said transferrable lane barrier dividers in position.

2. THE PRIOR ART

Existing lane barrier dividers are normally fixed in place to ensure stability of the structure against impact by vehicles. These barriers are of approx. 0.8 m high and 2.5 to 6 m long and provide an effective barrier against vehicles. However, these barriers are static and cannot be moved. Although other types of barriers, such as the type disclosed in U.S. Pat. No. 3,958,890, are moveable, they disclose other deficiencies. For example, the sections of the latter type of barrier must be transferred on a roadway by the use of a hoist and cable arrangement. In addition, such barrier does not include means for positively locking the sections of the barrier against relative pivotal movement and for selectively releasing the sections for transfer as a unit.

OBJECT OF THE INVENTION

The object of the present invention is to provide a transferable lane barrier of the kind disclosed in my co-pending application, Ser. No. 485,622, which is transferrable and at the same time satisfies the requirements for stability against lateral shift due to impact by vehicles.

SUMMARY OF THE INVENTION

This object is achieved by providing a lane barrier divider which has an elongated locking member which locks onto a substantial portion of lane barrier divider module and bridges across to and locks onto the adjacent lane barrier divider module to lock said lane barrier dividers together.

In one form, the lane divider module has a projection extending along the top thereof and the elongated locking member is in the shape of an inverted channel which fits over said projection with a small clearance. The elongated locking member is hingedly connected to the adjacent locking member and with the locking members staggered the lane divider modules are locked together.

Instead of the locking members being connected to the top of the modules, they could engage into a recess in the base of the modules.

DESCRIPTION OF PREFERRED EMBODIMENTS

Figure 1:
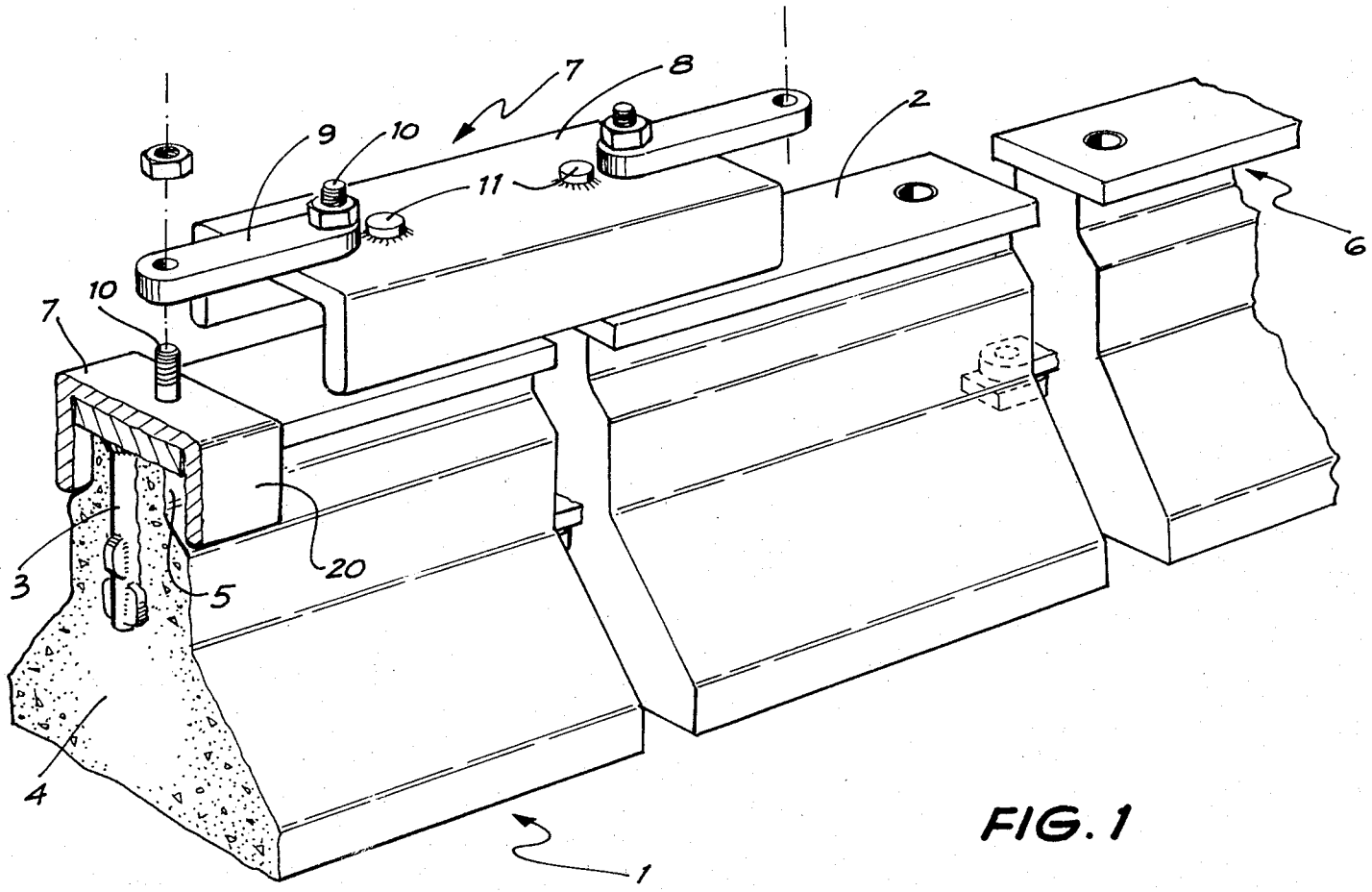
FIG. 1 is a view of one embodiment of a moveable lane divider barrier system according to the present invention with a section taken through one lane divider module with a locking member raised to out of engagement with the tops of the modules.

As shown in FIG. 1, a plurality of moveable lane divider barrier modules or sections 1 are of similar shape to those of my co-pending application, Ser. No. 485,622 filed Apr. 18, 1983. As described in such application, each adjacent pair of modules are hingedly connected together by the partially illustrated hinge connections, shown in FIGS. 1–5, which function to permit each adjacent pair of modules to pivot laterally relative to each other. As further described in such application and as shown, the modules are closely spaced in tandem relationship. However, these modules have a top which is formed of heavy steel plate rather than of concrete. The top 2 has projections 3 extending from along its length, set into the concrete 4 of the module, to ensure adequate bonding of the top 2 to the module 1. The top 2 and the neck 5 of the module 1 form uninterrupted and longitudinally extending transfer grooves 6 into which can be engaged transfer rollers or other suitable transfer devices in a similar method to that described in my beforementioned co-pending application. As described therein, the modules are thus adapted to be lifted and suspended above a roadway for transfer thereon.

To lock adjacent modules together, elongated locking members 7 in the form of an inverted channel 8 are used. These are pivotally connected together, for example, as shown in FIG. 1, by means of an elongated member 9 pivotally connected to bolts 10 on adjacent locking members 7. The locking members 7 are of approximately the same length as the modules 1 and are so shaped that the top 2 fits with a small clearance into the channel 8 such that when the locking members 7 are positioned so as to bridge across adjacent modules 1, the modules are secured against lateral pivotal movement relative to each other.

Figure 4:
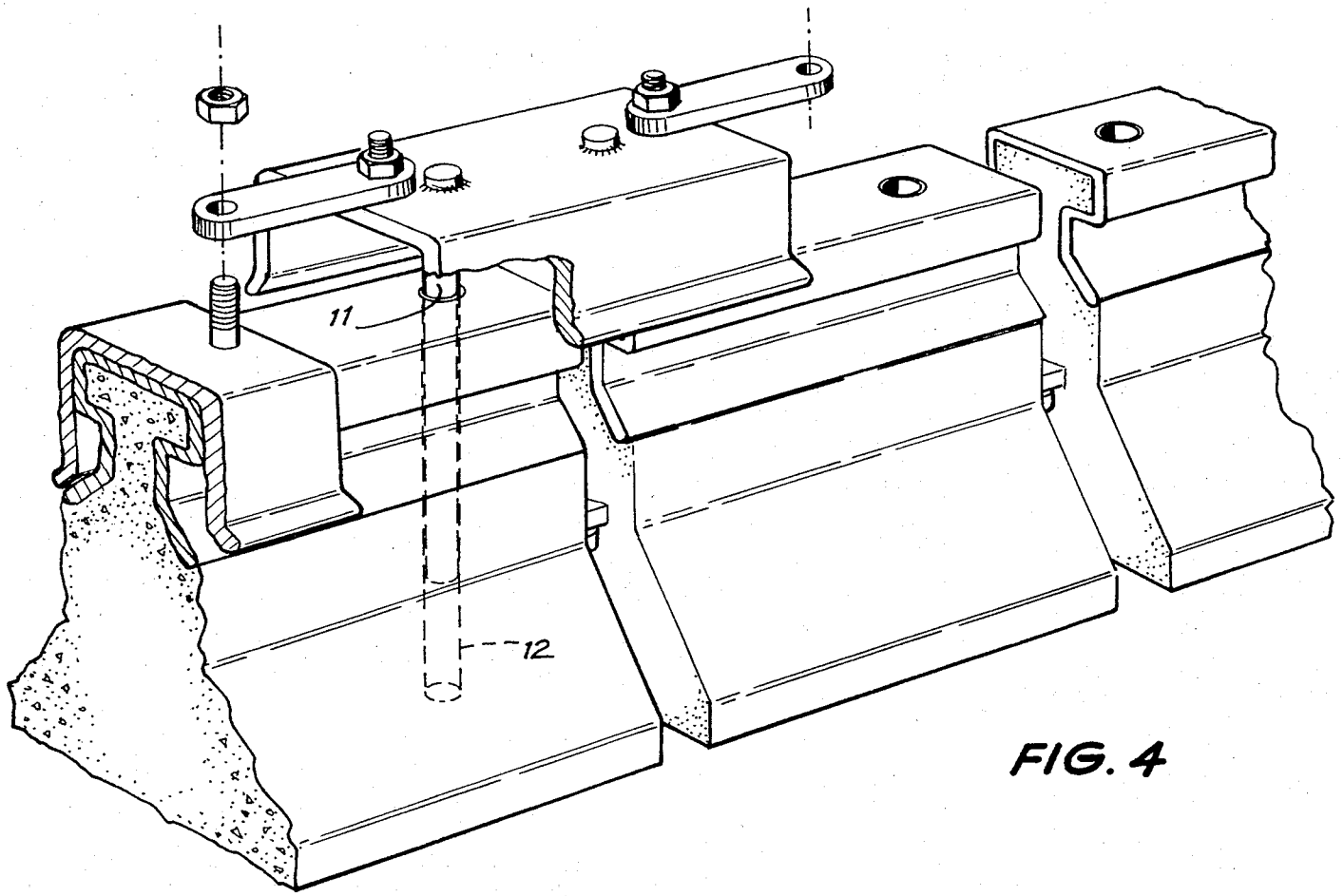
FIG. 4 shows a similar view as per FIG. 2 of a further embodiment of the present invention.

Preferably the locking members 7 are vertically slideably attached to adjacent modules by means of rods 11 which are slideably held in bores 12 in the modules as shown in dotted lines in FIG. 4. In the embodiment shown, each locking member 7 has two projecting rods which fit into respective bores on adjacent modules.

The side members 20 of the channel 8 extend downwardly to cover the transfer grooves 6 when the locking member is in its locking position.

Figure 2:
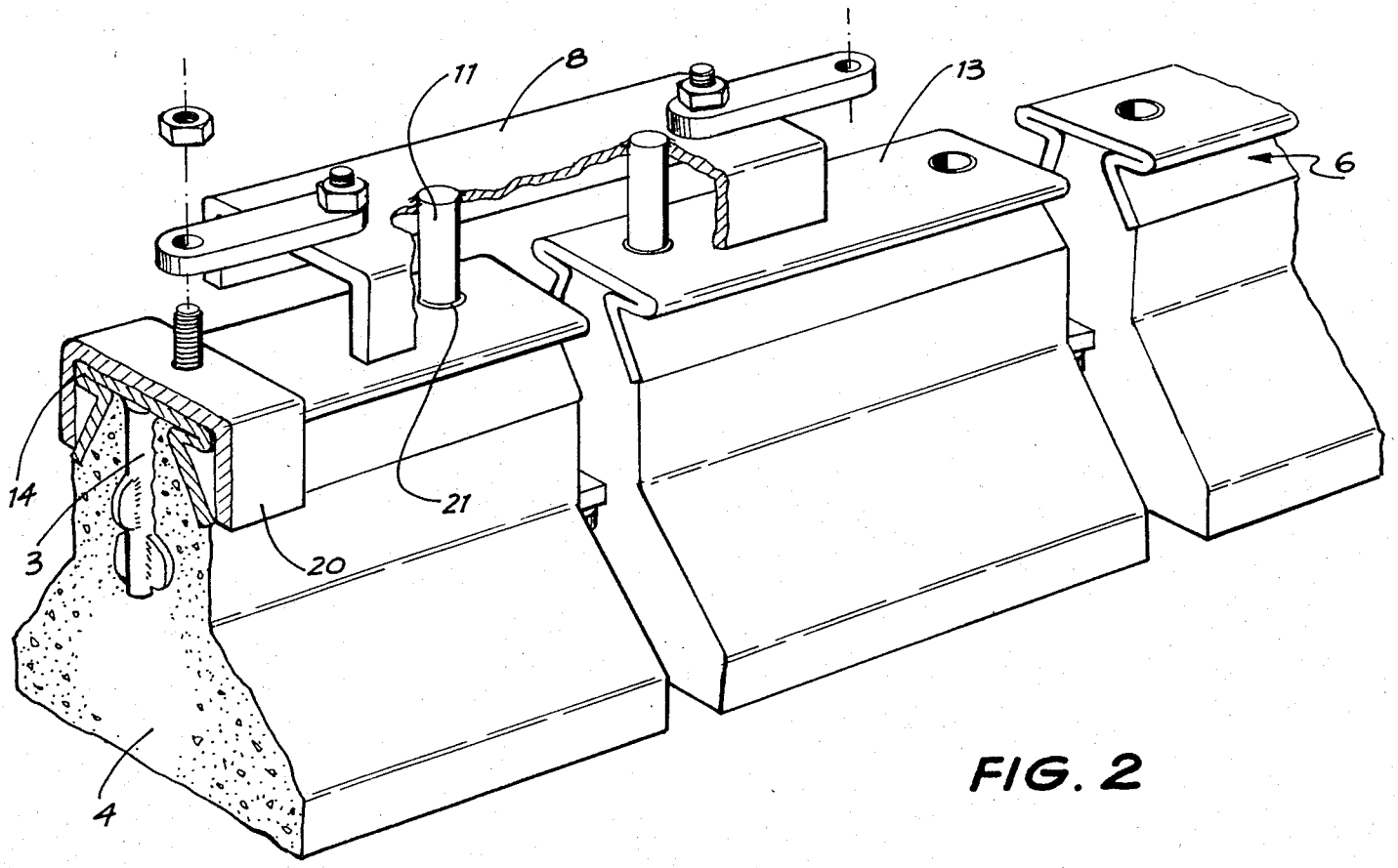
FIG. 2 shows a similar view as per FIG. 1 of another embodiment of the present invention with a cut away taken through a locking member.

Another embodiment of a lane divider barrier system is shown in FIG. 2 which is similar in construction to that shown in FIG. 1 except that the top 13 of the module and the transfer groove 6 are formed from a metal plate or sheet 14.

Figure 3:
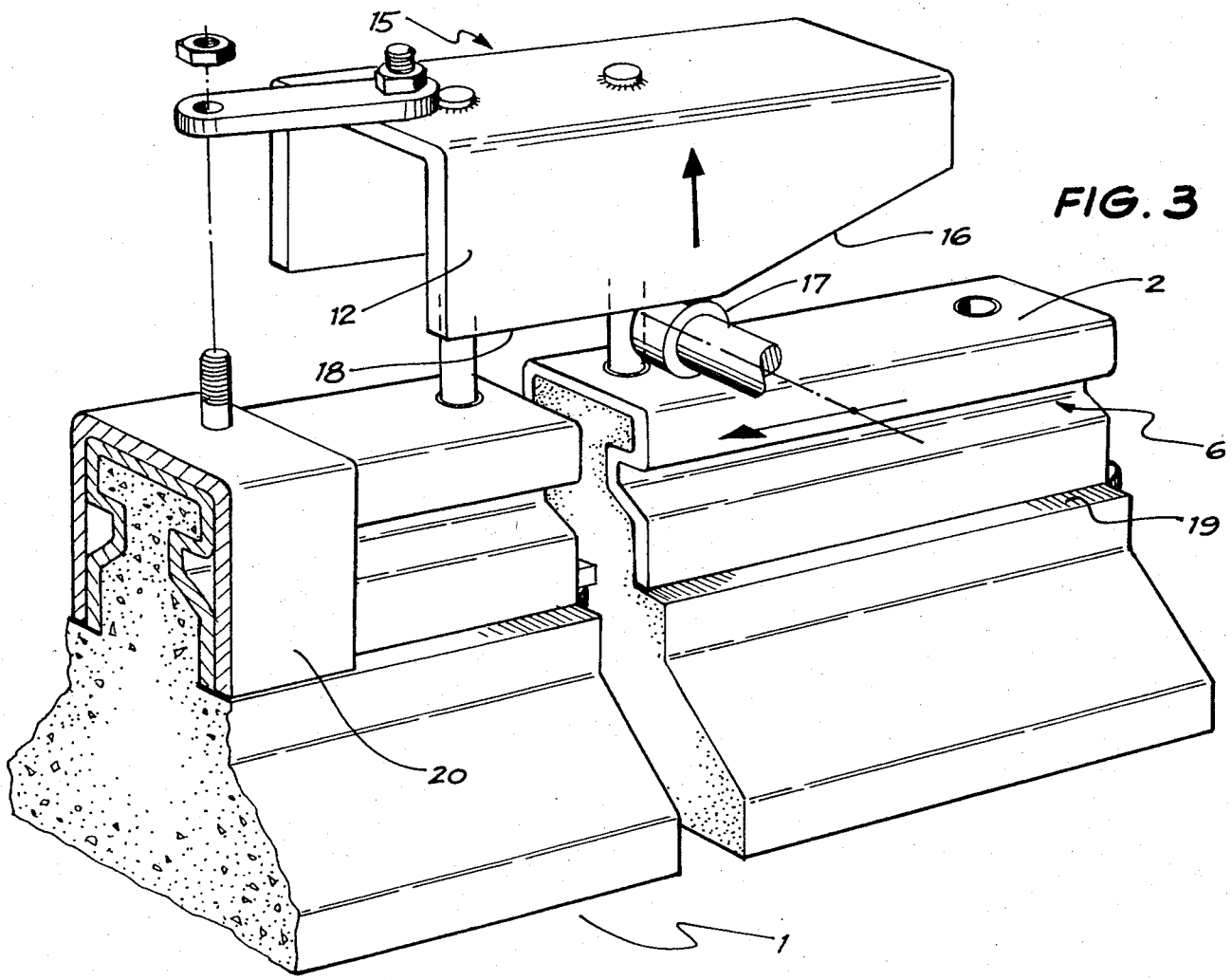
FIG. 3 shows a similar view as per FIG. 1 of a further embodiment of the present invention showing the raising of lead locking member by the lead roller of the transfer device (not shown)

A leading and modified locking member 15 is shown in FIG. 3. This member 15 has a tapered leading edge 16, which when the moveable barrier is to be removed, is engaged by a roller or other device which can be mounted on a similar transfer device as described in my co-pending application, Ser. No. 485,622. Therefore, when the transfer device moves along the modules, a ramp (not shown) engages under the leading edge 16 of the locking member 15 and forces the locking member to be lifted clear of the top 2 of the modules, such that the bottom edge 18 of each side 12 of the channel rests on a plurality of rollers 17.

The transfer groove 6 of the modules are then engaged by the transfer device (not shown) and the modules and locking members are lifted, suspended and transferred in a similar manner to the manner described in my co-pending application Ser. No. 485,622. As the modules are deposited in their new position, the locking members are lowered into locking engagement onto the top of the modules and positioning rollers (not shown) can be used to positively position the channels into locking engagement. To facilitate the positioning of the locking members, the channel can have tapered or flared sides or flanges as shown in FIG. 4.

As shown in FIG. 3, the sides 20 of the channel extend down past the transfer groove 6 and fit onto a shoulder 19. The module 1 has the surface of the concrete above the shoulder 19 clad in steel to protect the top and transfer groove.

To facilitate the movement of the rods 11 in the bores 12, the bores 12 are fitted with a polyurethane bush 21 (FIG. 2).

Figure 5:
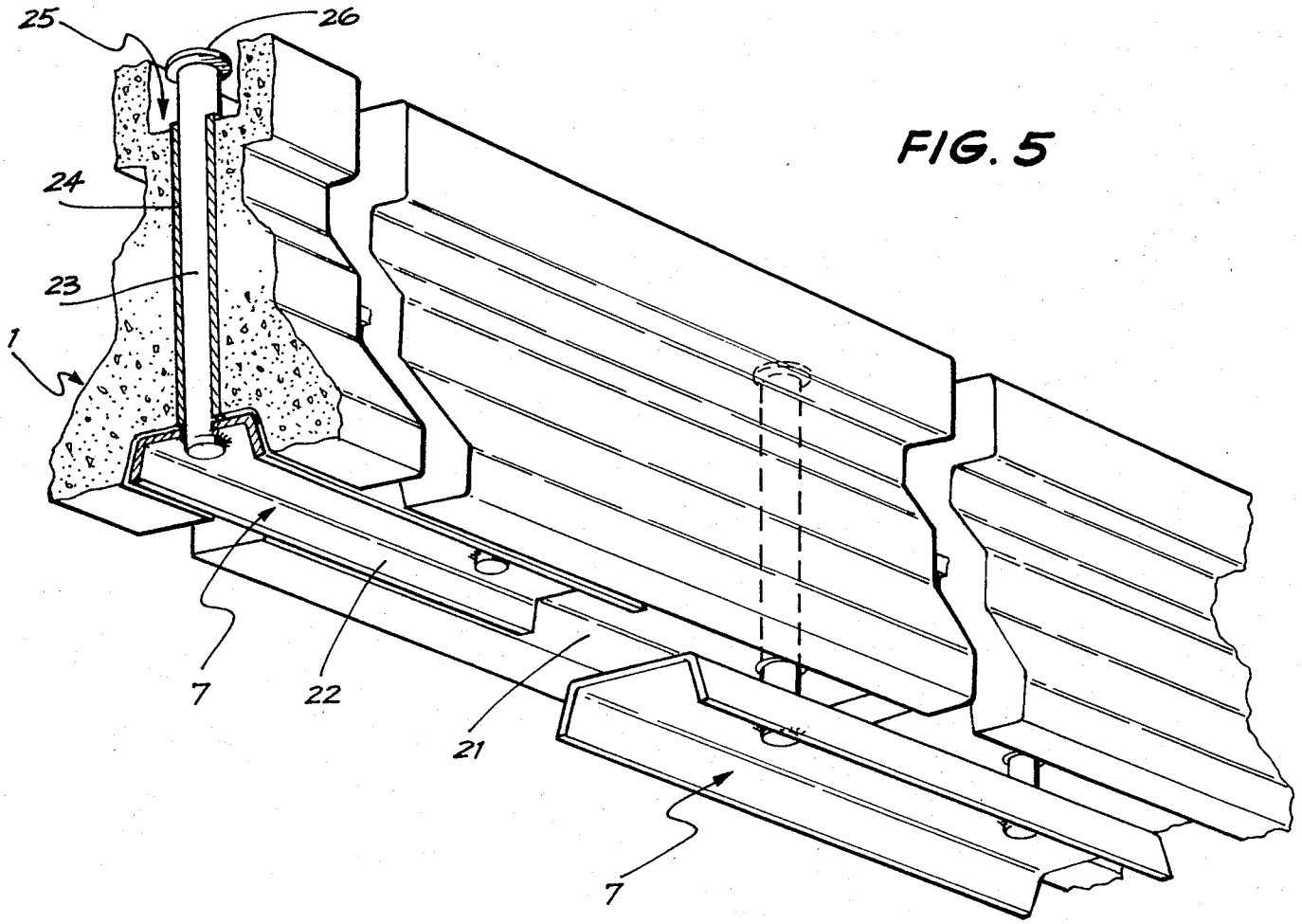
FIG. 5 shows a view of yet a further embodiment of the present invention.

The modules can be in the form shown in FIG. 5 wherein the locking members 7 are located in a longitudinal groove 27 located underneath the modules.

The locking members as shown in FIG. 5 are in the form of a channel 22 which is of outer complementary shape to the recess 27. As in the previous embodiments the locking members have projecting rods 23 slideably located in bores 24 in the modules and are positioned to bridge across two modules. The rods 23 terminate in recesses 25 located in the upper surface of the modules, and have a retaining means, such as the discs 26, located at or adjacent the free end of the rods, to prevent the rods 23 from falling out of the bores 24, when the modules are lifted. Preferably the recesses 25 are capped to prevent the ingress of matter into the recess.

Therefore, with this form of transferable lane barrier system, a transfer device as described in my co-pending application, Ser. No. 485,622, can be used to move the system provided that the modules are lifted a sufficient height to allow the locking member 7 to hang free of the groove 27. Once the modules have been fed along the transfer device to their new position, they are simply slid onto the ground wherein the locking members automatically engage into the recesses.

It should be obvious that modification can be made to the modules and the locking member, by altering their shapes and means of attachment or materials of construction without departing from the scope or spirit of the present invention.

I claim:

1. A transferable roadway lane divider comprising a plurality of upstanding divider sections, each having a base and an upper end, disposed in closely spaced and tandem relationship relative to each other to form a barrier, connecting means for pivotally connecting adjacent divider sections together for permitting them to pivot laterally relative to each other, transfer means formed in unobstructed relationship longitudinally throughout the entire length of the upper end of each divider section and aligned with the transfer means of a next adjacent divider section for receiving a common transfer apparatus to permit said divider sections to be lifted and suspended above a roadway for transfer thereon, lock means longitudinally bridging and engaging at least one pair of said divider sections for preventing them for pivoting laterally relative to each other, and guide means for reciprocally mounting said lock means for vertical movements on at least said pair of divider sections to selectively release said lock means from engagement with said pair of divider sections to permit said pair of divider sections to pivot laterally relative to each other.

2. The lane divider of claim 1 wherein said transfer means comprises a pair of laterally spaced undercut bearing surfaces defined on the upper end of said divider section to extend longitudinally throughout the entire length thereof and positioned to receive and engage said transfer mechanism thereunder.

3. The lane divider of claim 2 wherein the base of said divider section is substantially wider than the upper end thereof and wherein said bearing surfaces are defined on undersides of a pair of horizontally disposed flanges disposed in lateral alignment on the upper end of said divider section.

4. The lane divider of claim 3 wherein said divider section essentially comprises concrete and said base has an at least generally flat bottom surface constructed for surface mounting on said roadway.

5. The lane divider of claim 1 wherein said lock means comprises an elongated locking member mounted on one of the upper ends and undersides of the bases of said pair of divider sections.

6. The lane divider of claim 5 wherein said locking member comprises a channel.

7. The lane divider of claim 5 wherein said guide means comprises at least two vertically disposed rods secured to said locking member and wherein each rod is reciprocally mounted for vertical movements in a respective one of said pair of divider sections.

8. The lane divider of claim 7 wherein said locking member is disposed on the undersides of the bases of said pair of divider sections, a lower end of each of said rods is secured to said locking member and retaining means on an upper end of each of said rods for preventing said rods from being removed from said divider sections when said lock means is released from engagement with said pair of divider sections.

9. The lane divider of claim 8 further comprising a longitudinally extending groove defined on the underside of the bases of said pair of divider sections and wherein said locking member is disposed in said groove.

10. The lane divider of claim 5 wherein said locking member is mounted on the upper ends of said pair of divider sections in straddling relationship over opposite lateral sides thereof to cover said transfer means.

11. The lane divider of claim 5 further comprising means for pivotally interconnecting adjacent pairs of said locking members.

* * * * *

UNITED STATES PATENT AND TRADEMARK OFFICE

CERTIFICATE OF CORRECTION

PATENT NO. : 4,498,803

DATED : February 12, 1985

INVENTOR(S) : John P. Quittner

It is certified that error appears in the above-identified patent and that said Letters Patent is hereby corrected as shown below:

Column 4, line 10, "for" should read -- from --.

Signed and Sealed this

*Fourth* Day of *June 1985*

[SEAL]

*Attest:*

DONALD J. QUIGG

*Attesting Officer* *Acting Commissioner of Patents and Trademarks*